US005829265A

United States Patent [19]

Lord et al.

[11] Patent Number: 5,829,265

[45] Date of Patent: Nov. 3, 1998

[54] SUCTION SERVICE VALVE

[75] Inventors: Richard G. Lord, Tullahoma, Tenn.; Dennis R. Penge, Cicero, N.Y.

[73] Assignee: Carrier Corporation, Syracuse, N.Y.

[21] Appl. No.: 672,761

[22] Filed: Jun. 28, 1996

[51] Int. Cl.[6] ..... F25D 19/00; F16K 43/00

[52] U.S. Cl. ..... 62/298; 137/312; 137/315; 137/572; 251/228

[58] Field of Search ..... 62/216, 217, 298; 137/312, 315, 316, 334, 572; 251/228

[56] References Cited

U.S. PATENT DOCUMENTS

| | | | |
|---|---|---|---|
| 2,315,031 | 3/1943 | Wiegand | 137/572 |
| 2,338,953 | 1/1944 | Melke | 62/298 |
| 2,644,479 | 7/1953 | Rowley | 137/312 |
| 3,473,569 | 10/1969 | Guertin et al. | 137/614.06 |

FOREIGN PATENT DOCUMENTS

| | | | |
|---|---|---|---|
| 418003 | 10/1934 | United Kingdom | 251/228 |
| 667177 | 2/1952 | United Kingdom | 251/228 |

*Primary Examiner*—A. Michael Chambers

[57] ABSTRACT

A service valve for isolating the compressor of a chiller system from a flooded evaporator cooler that includes a suction pipe mounted in the top section of the evaporator that extends downwardly into the evaporator shell and a shut-off valve mounted inside the shell that is arranged to close against the bottom opening of the suction pipe. The valve is connected by linkage to a shaft that passes through the suction pipe outside the evaporator which when rotated, permits the valve to be opened and closed.

13 Claims, 3 Drawing Sheets

SUCTION SERVICE VALVE

BACKGROUND OF THE INVENTION

This invention relates to a refrigeration system and, in particular, to apparatus for improving and compacting a refrigeration system.

In many refrigeration systems a suction service valve is mounted in the refrigerant line connecting the outlet of the evaporator cooler with the suction inlet of the compressor. The suction service valve can be closed during maintenance periods to isolate the cooler from the compressor to better facilitate servicing of the various system components. In many refrigerant systems, particularly compact systems, there is afforded little room for the installation of a suction service valve and accordingly, the valve may not, under certain conditions, be provided as part of the overall system. Attempts to retrofit these systems with a suction service valve at some later point after the units have been placed in the field have generally proven to be less than satisfactory.

SUMMARY OF THE INVENTION

It is therefore a primary object of the present invention to improve refrigeration systems.

It is a further object of the present invention to compact the size of refrigeration systems.

A still further object of the present invention is to provide a suction service valve that requires a minimum amount of space for mounting and actuating the valve.

Another object of the present invention is to provide a space saving suction service valve that can be easily added to the heat exchanger once it has been built.

These and other objects of the present invention are attained by means of a suction service valve for connecting the evaporator of a refrigeration system with the system compressor. The valve can be cycled to isolate the evaporator cooler of a refrigeration system from the system compressor and includes a suction pipe that is at least partially contained inside the shell of the evaporator cooler. A shaft is rotatably mounted within the suction pipe and is connected to a valve located inside the evaporator shell by means of a linkage mechanism that is passed downwardly through the suction pipe. By rotating the shaft, the valve can be moved from an opened position beneath the bottom opening of the pipe to a closed position in sealing contact against the bottom of the pipe to prevent refrigerant from moving between the evaporator and the compressor.

In one form of the invention, a cylindrical sleeve is mounted inside a flange connection of an evaporator which is typically used to couple the evaporator to the suction side of a compressor. A shaft is rotatably mounted in the sleeve and is connected to a valve that hangs down below the sleeve. The valve is configured so that it can be inserted along with the sleeve into an existing connection without having to remove the connection from the evaporator shell. Here again, the valve is joined to the shaft by a linkage so that rotation of the shaft will draw the valve upwardly from an opened position into a closed position against the bottom opening of the sleeve.

BRIEF DESCRIPTION OF THE DRAWINGS

For a better understanding of these and other objects of the present invention, reference will be made herein to the following detailed description of the invention which is to be read in association with the following drawings, wherein.

DESCRIPTION OF THE INVENTION

Figure 1:
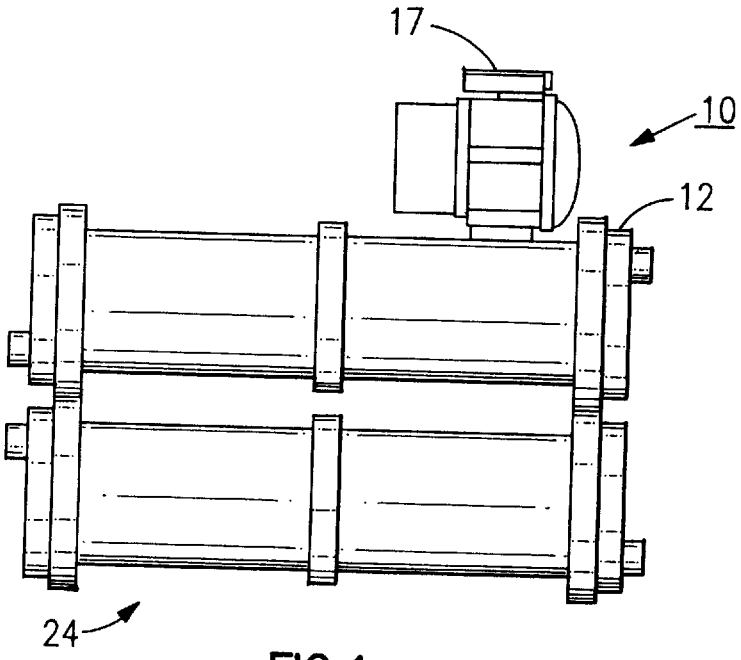
FIG. 1 is a plane view of a chiller system incorporating the teachings of the present invention.

Turning initially to FIG. 1, there is shown a front elevation of a compact chiller unit, generally referenced 10, wherein the cooler shell 12 is mounted over the condenser shell 24. A screw compressor 17 is mounted on top of the cooler shell in close proximity therewith. As will be explained in greater detail below, a low profile flange connection containing a suction service valve is used to place the evaporator in fluid flow communication with the inlet to the compressor. The connection occupies little space and thus permits the compressor to be mounted as close as possible to the evaporator shell. In one form of the invention, the valve is assembled upon a sleeve and the assembly is passed into an existing flange coupling thus permitting the valve to be easily retrofitted to existing systems in the field. Although only a single compressor is shown as being utilized in the present system, it should be clear to one skilled in the art that more than one compressor may be employed in the system without departing from the teachings of the present invention.

Figure 2:
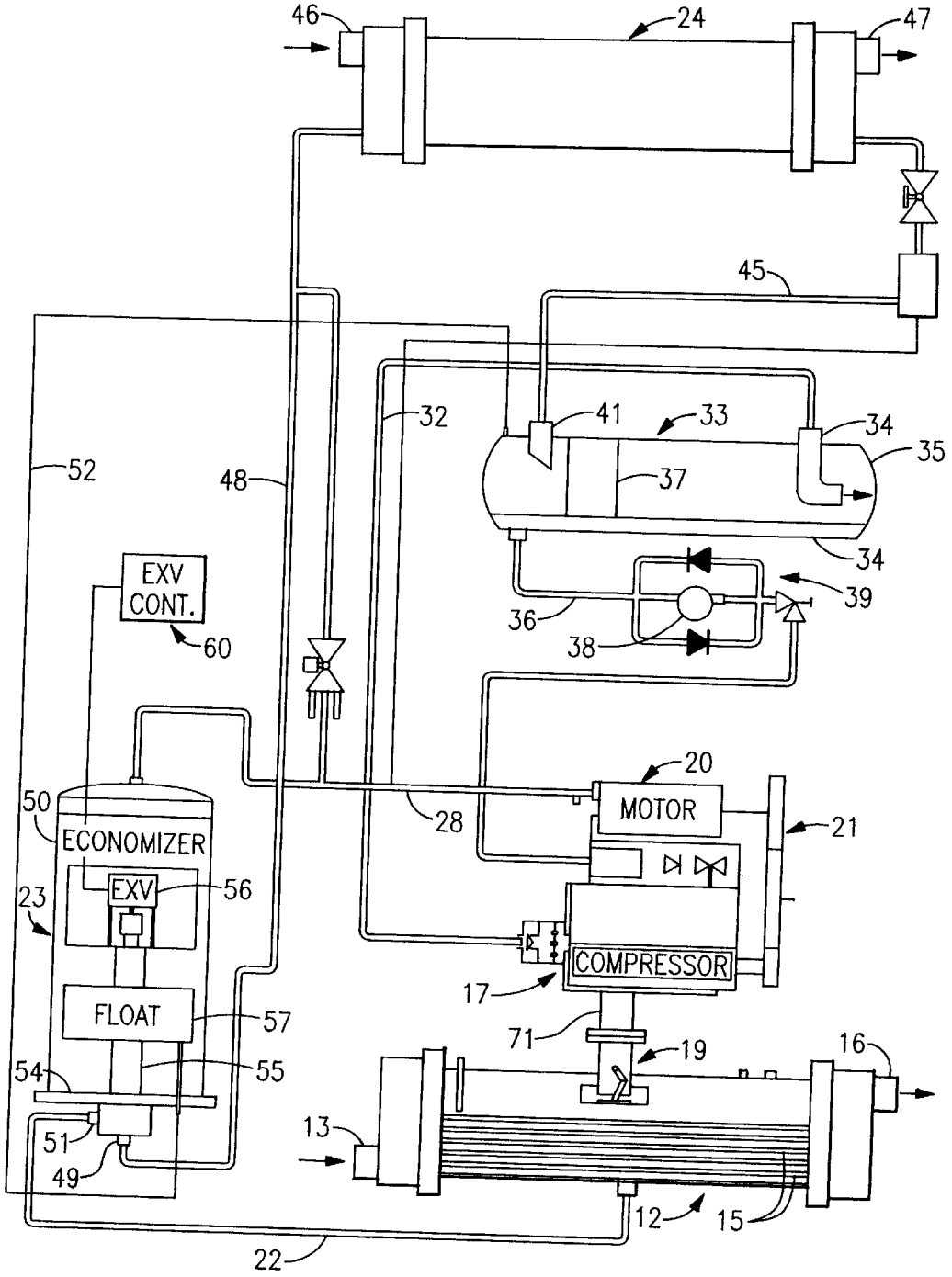
FIG. 2 is a schematic drawing showing in greater detail the component parts of the chiller system of FIG. 1.

With further reference to FIG. 2, the present chiller system 10 employs an evaporator 12 to chill water. The water enters the evaporator shell through an inlet port 13 and is circulated through a series of tubes 15 before being discharged through an exit port 16. The cooler is flooded with liquid refrigerant at a suitably low temperature so that it absorbs heat from the water being circulated through the heat exchanger tubes. Accordingly, some of the refrigerant is evaporated to a vapor which is collected in the top section of the evaporator shell and then passed on to the system compressor 17.

The compressor employed in the system is a screw compressor although the practice of the present invention is not limited to use in conjunction with this particular type of compressor and has wider application in various refrigeration systems using other types of compressors. The suction side of the compressor is connected directly to a flanged connector 19 mounted in the top of the evaporator shell so that vapor collected in the shell will pass directly into the suction inlet of the compressor when the system is being serviced. As will be explained in greater detail below, a suction service valve is contained within the flanged connector which can be manually cycled to shut off the flow of refrigerant from the evaporator to the compressor. The rotors of the compressor are coupled to a compressor motor 20 by means of a gear train 21. As is typical in most screw compressors, lubricating oil is distributed to the rotors and the bearings of the machine and, as a result, oil is compressed along with the refrigerant within the compression chamber.

The compressed gas that is discharged from the compressor is delivered to an oil separator 33 by means of a gas line 32. The compressed gas entering the separator is initially directed against one side wall 35 of the separator shell through a discharge nozzle. Upon impact, a portion of the oil is reduced to a liquid that drops to the bottom of the tank.

The remaining gas mixture is then passed through a wire mesh screen 37 where the remaining oil is separated from the refrigerant vapor and is collected with the previously separated oil in the bottom of the shell. An oil return line 36 is connected into the bottom of the separator shell through which the separated oil is returned to the compressor pump for recirculation.

A small prelube pump 30 is connected into the oil return line which is actuated for a short period of time at start up to pre-lubricate the rotors and bearings of the machine. When the pressure in the system reaches a desired operating level, the prelube pump is shut down and the oil is rerouted about the pump by means of the check valve network 39.

Refrigerant vapor is drawn out of the separator through a vapor line 45 and delivered into the shell of condenser 24. The present system utilizes a water cooled condenser although any type of condenser that is known and used in the art may be similarly employed. Cooling water is delivered into the shell via inlet 46 and is passed through a series of heat exchanger tubes (not shown) prior to leaving the condenser through outlet 47. Heat from the refrigerant is rejected into the cooling water thus reducing the refrigerant to a liquid is collected in the bottom of the condenser shell.

The liquid refrigerant collected in the condenser passes through a liquid line 48 into a flash tank economizer 23. The economizer is housed within a vertically disposed tank 50 that is attached to a base 54 which containing a refrigerant inlet 49. A stand pipe 55 is mounted on the base which surrounds a smaller diameter refrigerant tube to create an expansion chamber therebetween. The tube delivers the incoming liquid refrigerant to an electronically controlled expansion valve (EXV) 56, the function of which is described in greater detail in U.S. Pat. No. 4,523,435 and is incorporated by reference. The operation of the EXV is regulated by a controller unit 60 in response to one or more sensed conditions within the system. The EXV serves to rapidly expand or flash the incoming liquid refrigerant to a lower temperature and pressure wherein some of the liquid is vaporized. The flash gas is collected in the top section of the tank and the liquid is collected in the bottom of the tank. The collected flash gas is fed back to the compressor through the compressor motor section and thus provides for additional motor cooling. After passing through the motor section, the flash gas is introduced into the compression chamber of the compressor downstream from the inlet within a region where the chamber pressure is about equal to or slightly less than the economizer pressure maintained in the economizer.

The liquid that is collected in the bottom of the economizer tank is expanded or throttled a second time to a lower temperature and pressure. The second expansion is accomplished by a float type flow metering device. This flow metering device is disclosed in U.S. Pat. No. 5,285,653 and the disclosure in this patent is herein incorporated by reference. An annular float surrounds the standpipe 55 and is adapted to float upon the liquid refrigerant contained in the sump of the economizer tank. A series of vertically disposed metering slots are circumferentially spaced about the wetted lower section of the stand pipe and a metering sleeve is slidably mounted within the standpipe behind the slots. The sleeve is connected to the float and is thus positioned vertically as the float moves up or down in the liquid refrigerant to vary the size of the slotted openings in response to the level of refrigerant in the sump. A vapor injection duct 52 supplies refrigerant vapor from the oil separator at a high pressure beneath the float to maintain a positive buoyancy therein relative to the refrigerant liquid in the economizer tank.

The twice expanded throttled refrigerant two phase fluid in the expansion chamber is delivered into the evaporator via liquid line 22 where it absorbs heat from the water being chilled and is thus reduced once again to a vapor.

Figure 3:
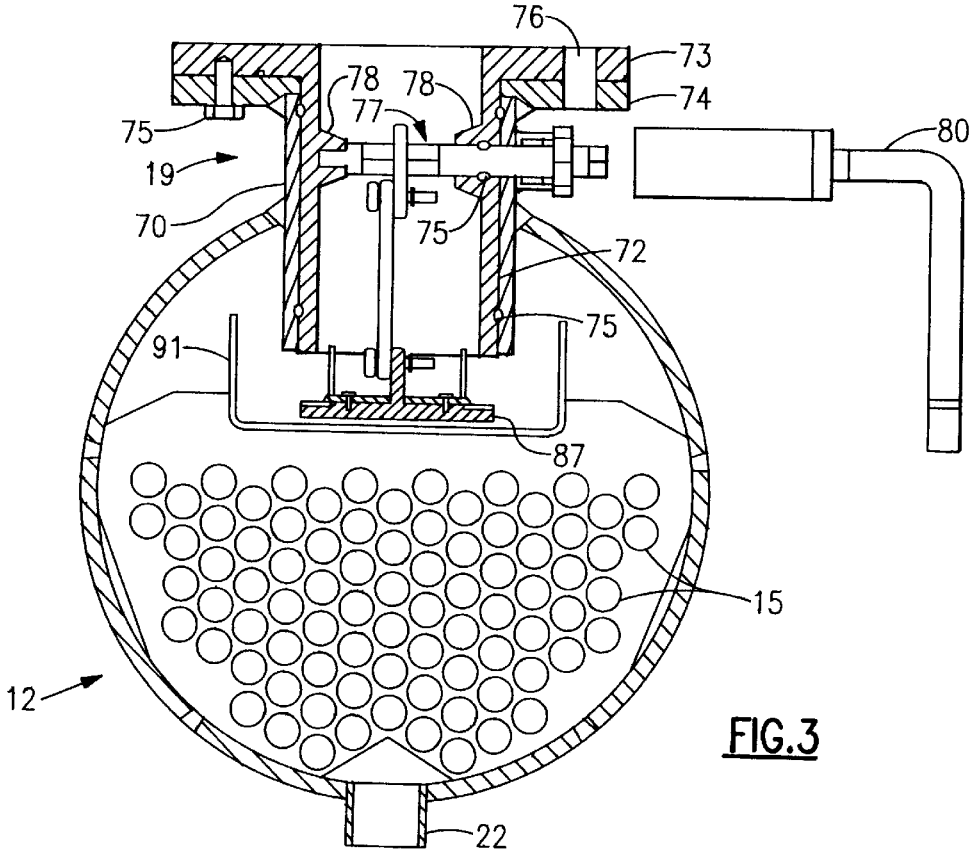
FIG. 3 is an enlarged end view in section of the evaporator used in the present chiller showing the suction service valve of the present invention installed therein.

FIG. 3 is a cross sectional view of the evaporator cooler shell showing the water tubes 15 mounted in the bottom of the shell. Liquid refrigerant in the shell is maintained at a level so that the water tubes are completely covered with the liquid phase refrigerant. The vapor phase is generated in the shell collected in the top of the shell. A typical flanged connector 70 is mounted in the top of the evaporator shell with the cylindrical body of the connector extending downward some distance into the shell. A flanged sleeve 72 is inserted downwardly into the connector so that the flange 73 of the sleeve rests upon the flange 74 of the connector. The flanges are secured together in face-to-face contact by suitable means of threaded fasteners 75. Aligned bolting holes 76 are also spaced about the flanges that permits the connector 71 (FIG. 1) to be bolted to a mating connector in the suction line of the compressor.

Figure 4:
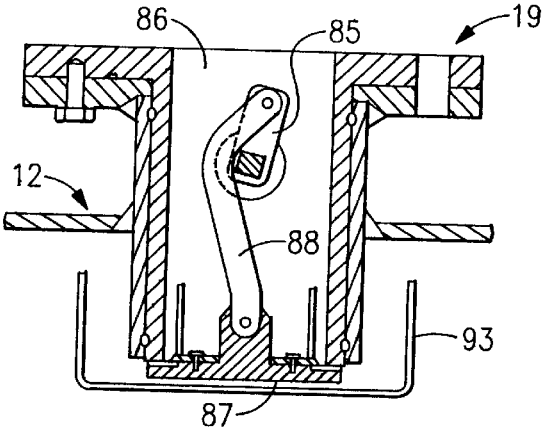
FIG. 4 is a side elevation in section of the suction service valve showing the valve in a general condition.
Figure 5:
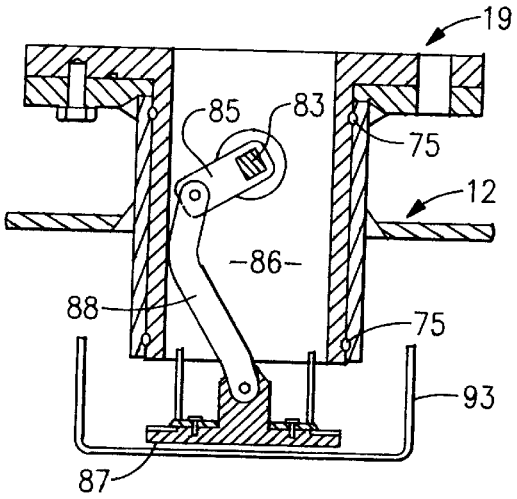
FIG. 5 is a side elevation similar to that of FIG. 5 showing the valve in a closed position.

As further illustrated in FIGS. 4 and 5, a vertically disposed shaft 77 is mounted for rotation in bearing surface 78—78 provided in the sleeve 72. One end of the shaft extends horizontally through both the sleeve body and the connector body and contains square head 79 at its extended end that is engageable by a suitable tool 80 for manually rotating the shaft in the bearing surfaces. Seals such as O-ring seals 82—82 are mounted between the sleeve 72 and the connector 19, as well as between the shaft and the sleeve to prevent refrigerant from escaping from the system. In assembly the body section of the sleeve extends downwardly to a slightly lower elevation than the body section of the connector.

The central portion of the shaft 77 contains a square section 83. A crank arm 85 is affixed to the square section of the arm so that it will rotate with the shaft. The length of the crank arm is slightly less than the radius of the sleeve opening 86 so that the arm can swing freely within the opening. A valve 87 is connected to the crank arm by a link 88 which is pinned for rotation at one end in the crank arm and at the other end in an ear 89 that is affixed to the top of the valve. A plurality of vertically disposed guide pins are mounted in the top of the valve that extend upwardly into the sleeve opening to guide the valve as it is moved between the opened position shown in FIG. 4 and the closed position shown in FIG. 5.

An oil trap 93 is mounted inside the evaporator shell immediately beneath the opening in the connector to capture any oil that might pass downward from the compressor into the evaporator. The trap also serves to collect oil that is carried over from the evaporation process. When the valve is in the opened position as shown in FIG. 5, the valve is situated just above the floor of the trap. Revolving the shaft from the open position to the closed position as shown in FIG. 4 causes the linkage to draw the valve upwardly into sealing contact against the lower face of the sleeve thus preventing refrigerant from flow between the evaporator and the compressor. A slight amount of over rotation is provided by the linkage so that the valve locks in the closed position.

As should be evident from the description above, the present suction service valve is a space saving device that can be installed as original equipment in refrigeration systems or easily retrofitted to existing systems that are in the field.

While this invention has been explained with reference to the structure disclosed herein, it is not confined to the details set forth and this invention is intended to cover any modifications and changes as may come within the scope of the following claims:

What is claimed is:

1. A service valve for selectively isolating a compressor of a chiller system from an evaporator cooler shell that includes a suction pipe that is mounted in the top section of the evaporator shell for connecting the evaporator to the suction side of the compressor, said suction pipe having a top opening located outside the evaporator shell and a bottom opening located inside said shell;

a shaft rotatably mounted in said suction pipe at a location outside of said shell, means to rotate said shaft between a first position and a second position, a shut-off valve means connected to said shaft by linkage means so that said valve is located beneath the bottom opening of said suction pipe inside said shell when said shaft is placed in said first position whereby refrigerant in said evaporator shell can move freely between the evaporator and the compressor, and said valve being seated in closing contact over the bottom opening in said suction pipe for closing said bottom opening when said shaft is in second position whereby refrigerant is prevented form moving between said evaporator and said compressor.

2. The service valve of claim 1 wherein said linkage means includes a crank arm affixed for rotation to said shaft inside the suction pipe and a link means pivotally mounted at one end to said crank arm and at the other end to said valve means.

3. The service valve of claim 2 wherein the opening in said suction pipe is cylindrical and the crank arm has a length that is less than the radius of said opening whereby the crank arm can rotate freely within said suction pipe.

4. The service valve of claim 1 wherein said shaft extends through said suction pipe and the extended end of said shaft has a coupling means for connecting said shaft to a means for rotating said shaft.

5. The service valve of claim 1 that further includes an oil tray mounted inside said evaporator shell beneath said valve means for collecting oil that drains from said suction pipe.

6. The service valve of claim 1 wherein said suction pipe further includes a connecting means located outside of the shell for coupling the suction pipe to the inlet of the compressor.

7. In a refrigeration system having an evaporator shell and a compressor mounted over the evaporator shell, a service valve for isolating the evaporation from the compressor that includes a suction pipe that is mounted in the top section of an evaporator shell, said suction pipe having an opening passing therethrough, a removable hollow sleeve mounted inside the suction pipe, that passes downwardly into the evaporator shell, said sleeve having bearing means for rotatably supporting a shaft mounted within the sleeve, said shaft extending outwardly through co-axial holes formed in said sleeve and said pipe, means for rotating said shaft between a first position and a second position, a valve means connected to said shaft by linkage means so that said valve is located inside the evaporator shell beneath said insert when said shaft is in a first position whereby refrigerant in said evaporator can pass freely between said evaporator and said compressor, and said valve being arranged to seat in closing contact over the bottom opening in said insert when the shaft is moved to said second position whereby refrigerant is prevented from moving between the evaporator and compressor, and said valve means being configured so that it is insertable into the evaporator through the opening in said suction pipe.

8. The service valve of claim 7 having sealing means between the suction pipe and the sleeve to prevent refrigerant from moving therebetween.

9. The service valve of claim 7 wherein said linkage means includes a crank arm affixed for rotation to said shaft inside said sleeve and a link means pivotally connected at one end to said crank and at the other end to said valve means.

10. The service valve of claim 9 wherein said sleeve is cylindrical in form and the crank arm has a length that is less than the inside radius of the sleeve.

11. The service valve of claim 7 wherein the extended end of said shaft has a means for connecting said shaft to a means for rotating said shaft.

12. The service valve of claim 7 that further includes an oil tray mounted inside said evaporator shell beneath said valve means.

13. The service valve of claim 7 that further includes a flanged coupling for connecting the suction pipe to the inlet of the compressor.

* * * * *